US008744099B2

(12) United States Patent
Matsui et al.

(10) Patent No.: US 8,744,099 B2
(45) Date of Patent: Jun. 3, 2014

(54) BATTERY COMPARTMENT FOR CONDENSER MICROPHONE

(75) Inventors: Noriko Matsui, Tokyo (JP); Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 341 days.

(21) Appl. No.: 13/114,115

(22) Filed: May 24, 2011

(65) Prior Publication Data

US 2011/0293116 A1 Dec. 1, 2011

(30) Foreign Application Priority Data

May 28, 2010 (JP) ..... 2010-122294

(51) Int. Cl.
*H04R 25/00* (2006.01)

(52) U.S. Cl.
USPC ..... 381/176; 381/122; 381/399

(58) Field of Classification Search
USPC ..... 381/111, 113, 399, 176, 122
See application file for complete search history.

(56) References Cited

U.S. PATENT DOCUMENTS

| | | | | |
|---|---|---|---|---|
| 6,856,689 | B2 * | 2/2005 | Sudo et al. | 381/355 |
| 7,427,705 | B2 * | 9/2008 | Rubens | 84/320 |
| 7,801,316 | B2 * | 9/2010 | Akino | 381/174 |
| 2002/0149928 | A1 * | 10/2002 | Watterson et al. | 362/184 |
| 2009/0322277 | A1 * | 12/2009 | Cargin et al. | 320/106 |

FOREIGN PATENT DOCUMENTS

| | | | |
|---|---|---|---|
| JP | 39-10227 | U | 4/1964 |
| JP | 53-59121 | U | 10/1976 |
| JP | 53-84024 | U | 12/1976 |
| JP | 2004-039598 | | 5/2004 |
| JP | 2006-033463 | A | 2/2006 |

* cited by examiner

*Primary Examiner* — Disler Paul
(74) *Attorney, Agent, or Firm* — Whitham Curtis Christofferson & Cook, PC

(57) ABSTRACT

A battery compartment for a condenser microphone includes a battery space configured to hold a battery; a battery outlet open to a portion of a peripheral wall of the battery space and allowing removal of the battery in the battery space; a lid covering the battery outlet; and a ribbon having one end portion fixed to an internal wall of the battery space and the other end portion disposed to be pulled out from the battery outlet and wrapping around an external periphery of the battery. The ribbon is conductive and the fixed end portion is grounded.

9 Claims, 8 Drawing Sheets

RELATED ART

RELATED ART

RELATED ART

RELATED ART

BATTERY COMPARTMENT FOR CONDENSER MICROPHONE

BACKGROUND OF THE INVENTION

1. Field of the Invention

The present invention relates to a battery compartment for a condenser microphone effectively preventing noise generated by a high-frequency current propagating from a battery unit to an electric circuit.

2. Related Background Art

An end of a battery must be hooked with a fingernail to remove the battery from a battery compartment of a conventional device that includes, as a power source, a cylindrical dry-cell battery, such as a size AA battery, loaded in the battery compartment. The end of the battery, however, cannot be readily hooked with a fingernail for removal in the case where a spring terminal provided inside the battery compartment strongly holds the terminal of the battery or in the case where the space is narrow between the end of the battery and the internal wall of the battery compartment. To address the circumstances, a ribbon is provided inside a battery compartment to facilitate removal of the battery, as disclosed in Japanese Unexamined patent application Publication No. 2004-039598.

Such a ribbon is used to facilitate removal of the battery in a condenser microphone that includes an internal battery as a power source or a power supply that includes a battery to supply external power to a microphone provided with no battery. In general, a condenser microphone is supplied with power from a phantom power supply apparatus if it is connected to the power supply apparatus, while being supplied with power from a battery loaded in a microphone main body or a power supply if it is not connected to a phantom power supply apparatus.

A typical power supply provided with a conventional battery compartment for a condenser microphone is illustrated in FIGS. 5 to 8C. The power supply 100 has an output terminal 101, an input terminal 102, and a battery compartment 103 loaded with a battery 107. The output terminal 101 is connected to an external phantom power supply apparatus through a microphone cable (not shown in the drawings) having a 3-pin microphone connector. The 3-pin input terminal 102 is connected to a condenser microphone main body (not shown in the drawing). The battery compartment 103 includes a lid 104, a battery space 105, and a ribbon 106. The ribbon 106 is composed of woven non-conductive fabric or a resin film. One end portion of the ribbon 106 is fixed to the internal wall of the battery space 105.

To load the battery 107, the ribbon 106 is placed along the internal wall of the battery space 105, as shown in FIG. 8A; the battery 107 is placed on the ribbon 106; and the lid 104 is closed. To remove the battery 107, the lid 104 is opened and the other end portion of the ribbon 106 is held and pulled up, as shown in FIGS. 8B and 8C. Thus, the battery 107 can easily be removed from a battery outlet, which is an open portion of the battery space 105.

Strong electromagnetic waves applied to a condenser microphone or a power supply connected thereto cause a high-frequency current to flow into the condenser microphone or the power supply. A semiconductor of an electric circuit inside the condenser microphone or the power supply detects the current, which generates noise. In a condenser microphone or a power supply that includes a battery in particular, a high-frequency current from a battery compartment propagates to an electronic circuit and generates noise. With recent spread of cellular phones, they are more frequently used proximate to condenser microphones or power supplies, thus causing the circumstance to be more significant.

SUMMARY OF THE INVENTION

In view of the circumstances above, an object of the present invention is to provide a battery compartment for a condenser microphone preventing a high-frequency current from propagating from the battery compartment to an electronic circuit even if strong electromagnetic waves are exerted on a condenser microphone or a power supply, thus effectively preventing noise generation.

A main aspect of the present invention provides a battery compartment for a condenser microphone including: a battery space configured to hold a battery; a battery outlet open to a portion of a peripheral wall of the battery space and allowing removal of the battery in the battery space; a lid covering the battery outlet; and a ribbon having one end portion fixed to an internal wall of the battery space and the other end portion disposed to be pulled out from the battery outlet and wrapping around an external periphery of the battery. The ribbon is conductive and the fixed end portion is grounded.

DESCRIPTION OF THE PREFERRED EMBODIMENTS

Figure 1:
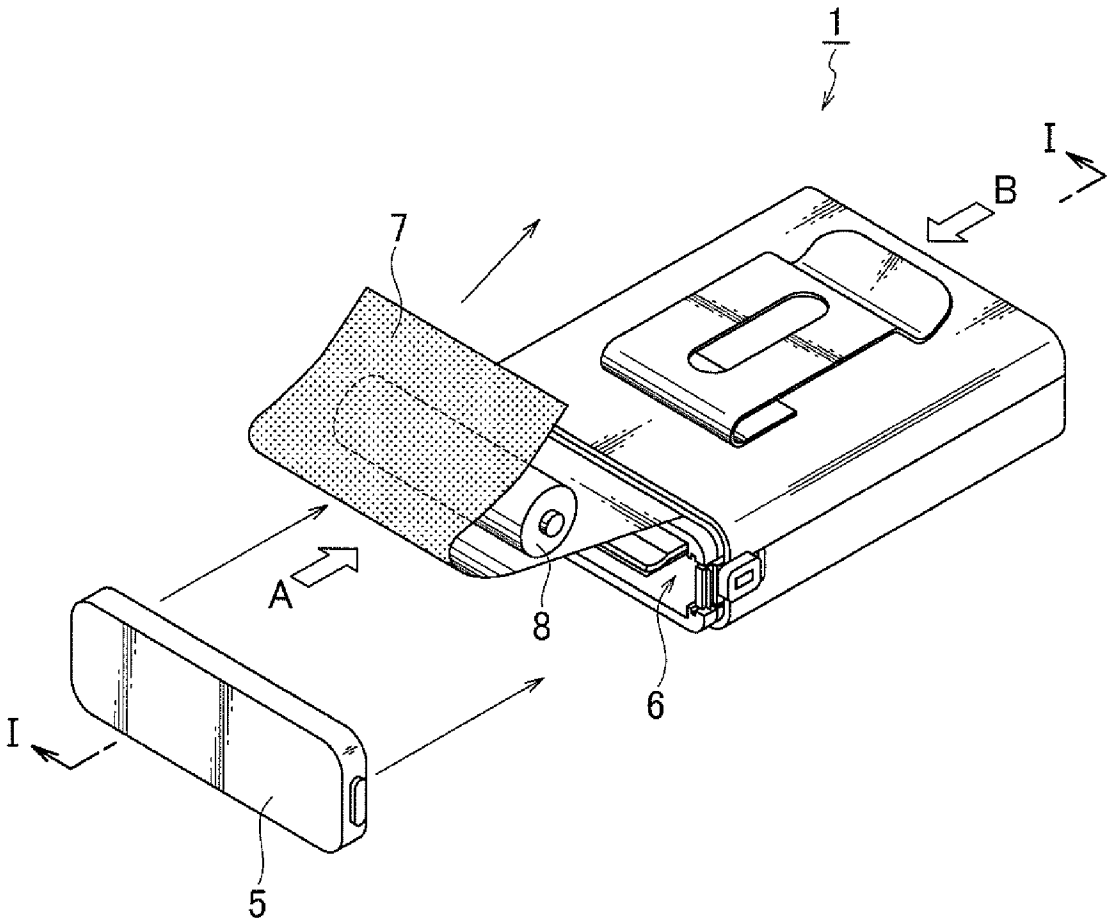
FIG. 1 is a perspective view illustrating an exemplary power supply provided with a battery compartment for a condenser microphone according to the present invention.
Figure 2:
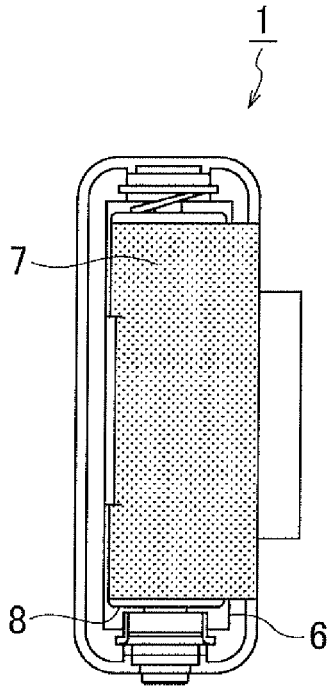
FIG. 2 is a front view of the power supply in FIG. 1 from direction A without a lid.
Figure 3:
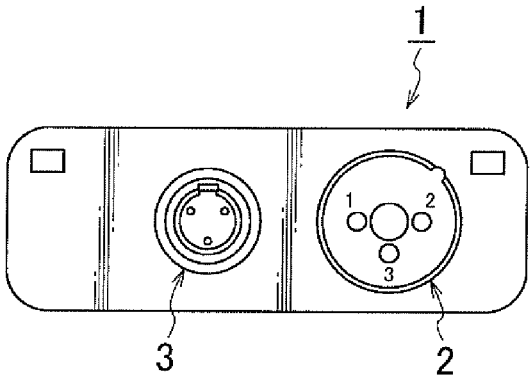
FIG. 3 is a rear view of the power supply in FIG. 1 from direction B.

An embodiment of a battery compartment for a condenser microphone according to the present invention is explained below with reference to the attached drawings. In the embodiment below, a power supply is explained as an example, in which the battery compartment for a condenser microphone according to the present invention is provided. A condenser microphone used along with the power supply does not have a battery compartment. If the condenser microphone is connected to a phantom power supply apparatus, the power supply apparatus supplies power. If the condenser microphone is not connected to a phantom power supply apparatus, a battery loaded in the power supply is connected to the condenser microphone supplies power.

An exemplary power supply provided with the battery compartment for a condenser microphone according to the present invention is illustrated in FIGS. 1 through 4C. The power supply 1 has an output terminal 2, an input terminal 3, and a battery compartment 4.

The output terminal 2 and the input terminal 3 are provided on one end surface in the longitudinal direction of the power supply 1. The output terminal 2 connects the power supply 1 to an external phantom power supply apparatus through a microphone cable (not shown in the drawings) having a 3-pin microphone connector. The input terminal 3 connects the power supply 1 to a condenser microphone main body (not shown in the drawings).

The battery compartment 4 includes a lid 5, a battery space 6, and a ribbon 7. The battery compartment 4 is provided on a longitudinal end surface of the power supply 1 opposite to the end surface on which the output terminal 2 and the input terminal 3 are provided. The lid 5 is composed of a conductive material, such as a metal or a conductive resin. The lid 5 covers an open portion to load and remove a battery 8 into and from the battery space 6 hereinafter described.

The battery space 6 has a size that can hold the battery 8. Two terminals are provided in the battery space 6 to be in contact with terminals on two sides of the battery 8. The battery space 6 is provided such that the longitudinal direction of the battery 8 is provided in parallel with the end surface of the power supply 1. The open portion of the battery space 6 is provided such that the battery 8 can be loaded and removed in the radial direction thereof (direction orthogonal to the axial direction of the battery). The battery space 6 is provided to load a single battery in the embodiment. The prevent invention, however, is not limited to loading of a single battery, but may load multiple batteries.

The ribbon 7 is composed of woven conductive fabric or a resin film. One end portion of the ribbon 7 is fixed to the internal wall of the battery space 6 so as to be in contact with a ground pattern on a board (not shown in the drawings) provided inside the power supply 1. The ribbon 7 has a width and length sufficient to cover the substantially entire external peripheral surface of the battery. The ribbon 7 may have a narrower width than the battery and a shorter length than the external periphery of the battery, provided that the ribbon 7 can exhibit an effect to shield electromagnetic waves from outside. The ribbon 7 has a width and length sufficient to cover a single battery in the embodiment. The present invention, however, is not limited to such a width and length. In the case where a battery compartment is configured to hold multiple batteries, the ribbon 7 may have a width and length sufficient to cover the multiple batteries.

Figure 4C:
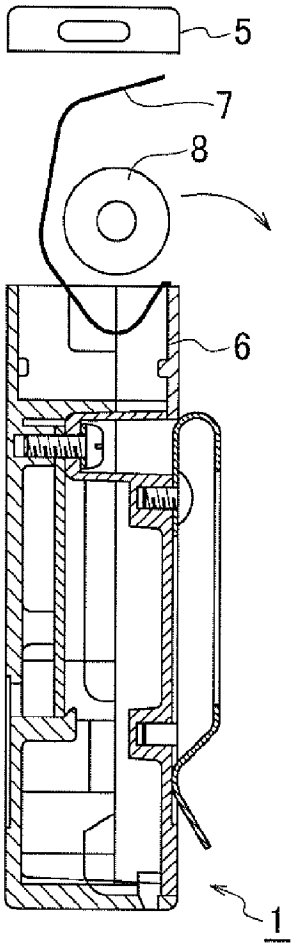
FIG. 4C is a cross-sectional view of the power supply along line I-I in FIG. 1 in a state where the battery is removed.
Figure 4B:
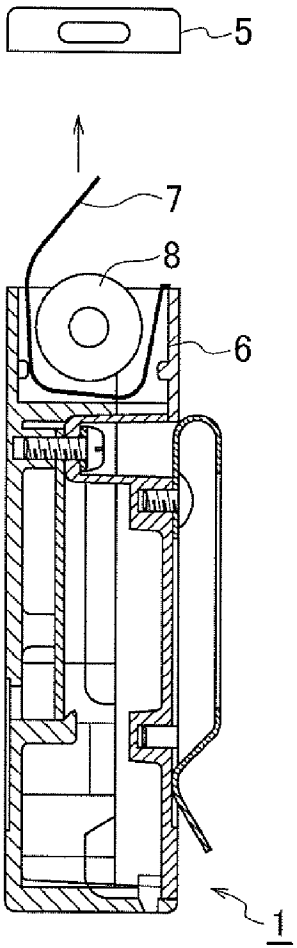
FIG. 4B is a cross-sectional view of the power supply along line I-I in FIG. 1 in a state where a ribbon is being pulled to remove the battery.
Figure 4A:
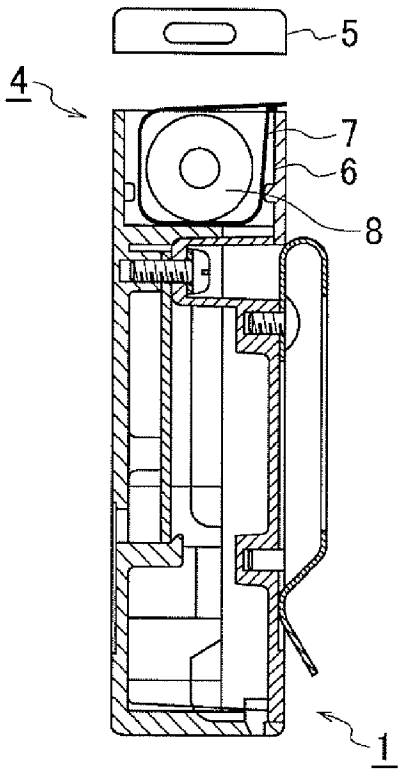
FIG. 4A is a cross-sectional view of the power supply along line I-I in FIG. 1 in a state where a battery is loaded.
Figure 5:
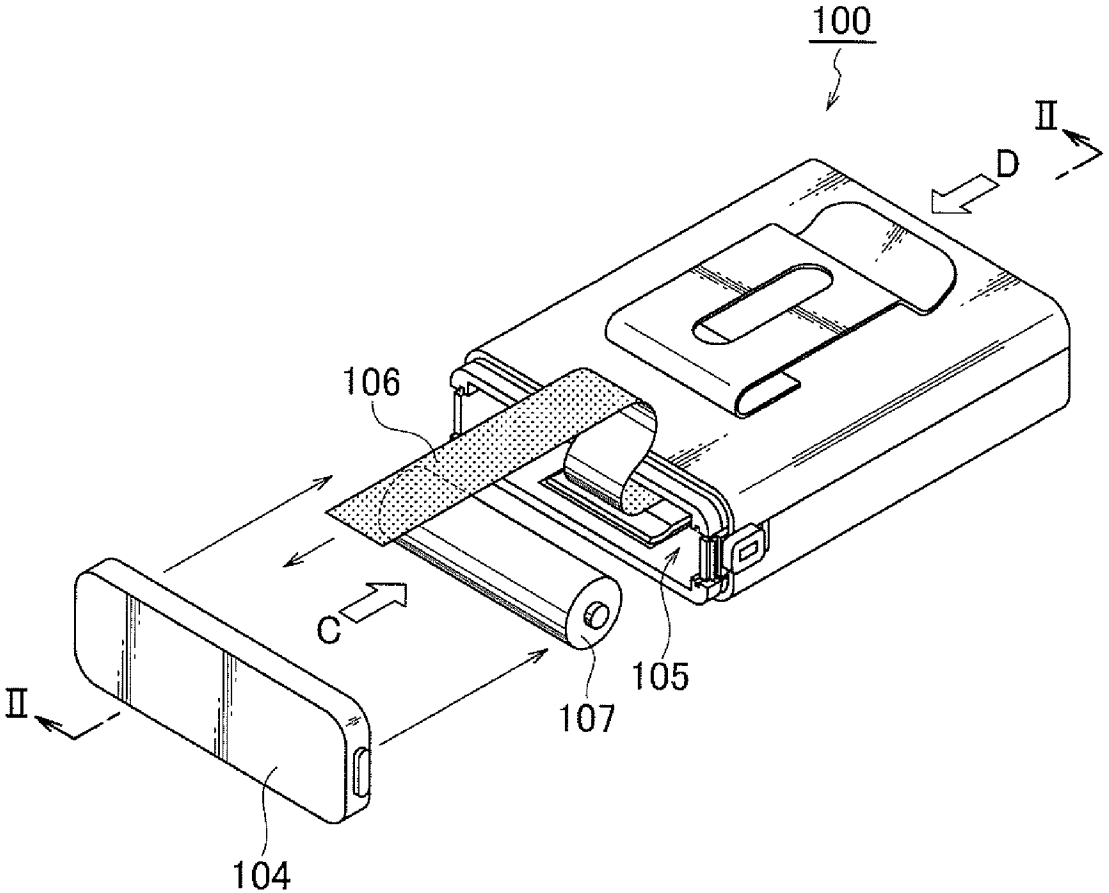
FIG. 5 is a perspective view illustrating a typical power supply provided with a conventional battery compartment for a condenser microphone.
Figure 6:
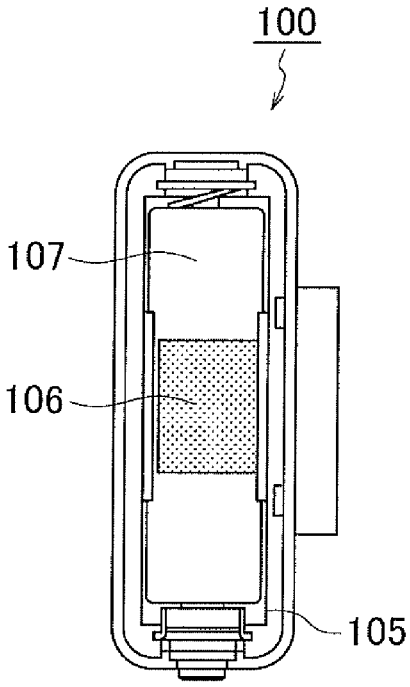
FIG. 6 is a front view of the power supply in FIG. 5 from direction C without a lid.
Figure 7:
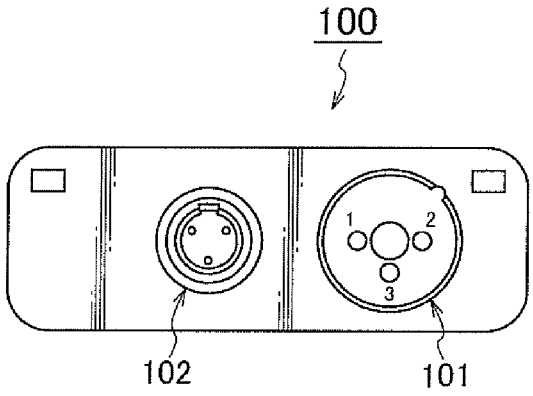
FIG. 7 is a rear view of the power supply in FIG. 5 from direction D.
Figure 8A:
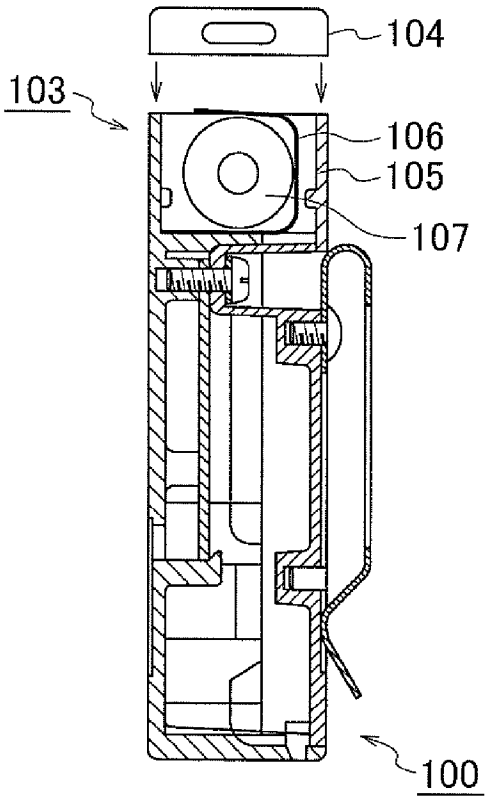
FIG. 8A is a cross-sectional view of the power supply along line II-II in FIG. 5 in a state where a battery is loaded.
Figure 8B:
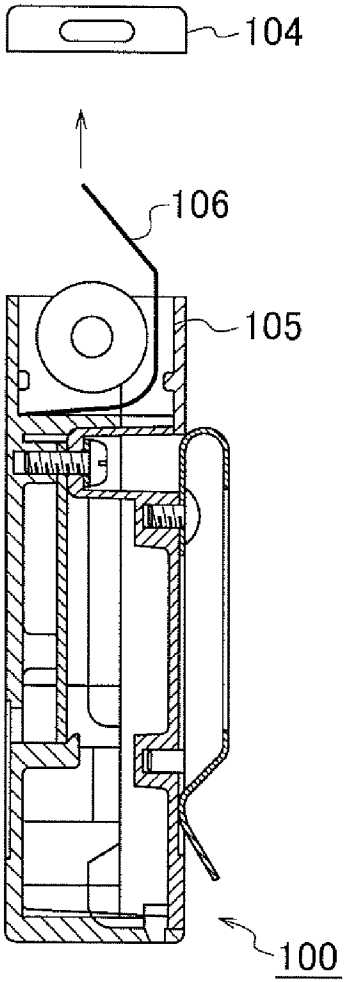
FIG. 8B is a cross-sectional view of the power supply along line II-II in FIG. 5 in a state where a ribbon is being pulled to remove the battery.
Figure 8C:
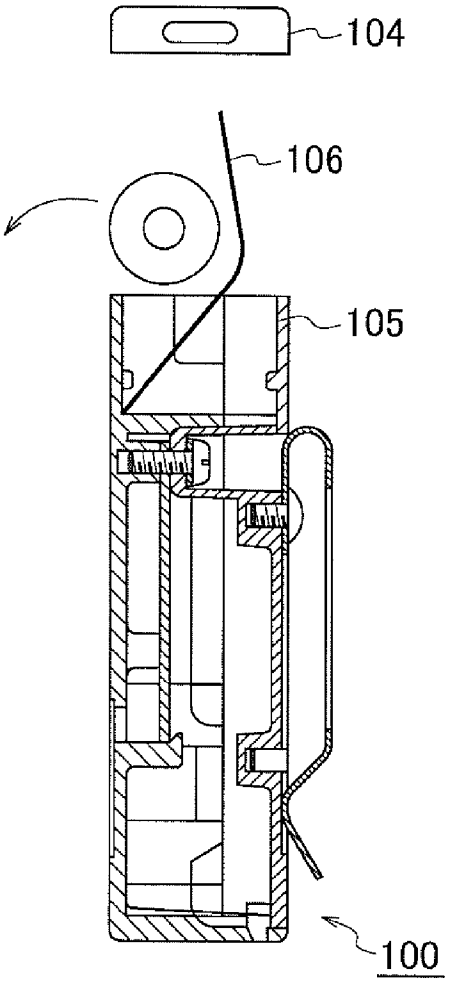
FIG. 8C is a cross-sectional view of the power supply along line II-II in FIG. 5 in a state where the battery is removed.

To load the battery 8, the ribbon 7 is placed along the internal wall of the battery space 6, as shown in FIG. 4A; the battery 8 is placed on the ribbon 7 and is loaded in the battery space 6; and the lid 5 is closed. Thereby, the substantially entire area of the external peripheral surface of is the battery 8 is covered. To remove the battery 8, the lid 5 is opened and the other end portion of the ribbon 7 is held and pulled up, as shown in FIGS. 4B and 4C. Thus, the battery 8 can easily be removed from a battery space 6.

In the battery compartment 4 for a condenser microphone according to the present invention, the ribbon 7 composed of a conductive material covers the substantially entire area of the external peripheral surface of the battery 8 and is in contact with the grounding terminal inside the main body of the power supply 1, thus shielding the battery 8 wrapped in the ribbon 7 from static electricity. Accordingly, even if a cellular phone is used proximate to the power supply, a high-frequency current is prevented from entering the battery 8 from outside and propagating to an electronic circuit. Thus, noise due to electromagnetic waves can be effectively prevented. Furthermore, the ribbon 7 composed of a conductive material can prevent vibration exerted on the power supply 1 from propagating to the battery 8 due to the elasticity of the conductive material. The battery 8 is stable, thus effectively preventing generation of mechanical noise. In addition, the conductive lid 5 further enhances the electrostatic shielding effect for the battery 8, thus further effectively preventing noise generated by electromagnetic waves.

The example in which the battery compartment for a condenser microphone is provided in the power supply is explained in the embodiment. The present invention, however, is not limited thereto. The battery compartment of the embodiment may be provided in a condenser microphone main body. In this case, the ribbon is provided so as to be in contact with a ground pattern on a circuit board inside the condenser microphone. Thereby, the effects the same as those in the embodiment can be achieved even in the case where the battery compartment is provided in the condenser microphone main body.

What is claimed is:

1. A battery compartment for a condenser microphone, comprising:

a battery space configured to hold a battery;

a battery outlet open to a portion of a peripheral wall of the battery space and allowing removal of the battery in the battery space;

a lid covering the battery outlet; and a ribbon having a first end portion fixed to an internal wall of the battery space and a second end portion disposed to be pulled out from the battery outlet and wrapping around an external periphery of the battery, wherein the ribbon is conductive, and wherein the first end portion is grounded and the second end portion is a free end, whereby preventing noise generated by electromagnetic waves.

2. The battery compartment for a condenser microphone according to claim 1, wherein the ribbon is elastic.

3. The battery compartment for a condenser microphone according to claim 2, wherein the ribbon comprises a conductive cloth.

4. The battery compartment for a condenser microphone according to claim 1, wherein the ribbon has a width covering a substantially entire area of an external peripheral surface of the battery.

5. The battery compartment for a condenser microphone according to claim 1, wherein the lid is conductive.

6. The battery compartment for a condenser microphone according to claim 5, wherein the lid comprises a metal.

7. The battery compartment for a condenser microphone according to claim 5, wherein the lid comprises a conductive resin.

8. The battery compartment for a condenser microphone according to claim 1, wherein the battery compartment is provided in a main body of the condenser microphone, and wherein the first end portion is in contact with the main body.

9. The battery compartment for a condenser microphone according to claim 1, wherein the battery compartment is provided in a main body of a power supply, and wherein the first end portion is in contact with the main body.

* * * * *